US011993881B2

(12) United States Patent
Yoshikawa et al.

(10) Patent No.: US 11,993,881 B2
(45) Date of Patent: May 28, 2024

(54) SEWING MACHINE

(71) Applicant: TISM CO., LTD., Kasugai (JP)

(72) Inventors: Katsuharu Yoshikawa, Tajimi (JP); Minao Chinen, Nagoya (JP)

(73) Assignee: TISM CO., LTD., Kasugai (JP)

( * ) Notice: Subject to any disclaimer, the term of this patent is extended or adjusted under 35 U.S.C. 154(b) by 111 days.

(21) Appl. No.: 17/779,173

(22) PCT Filed: Dec. 15, 2020

(86) PCT No.: PCT/JP2020/046654
§ 371 (c)(1),
(2) Date: May 24, 2022

(87) PCT Pub. No.: WO2021/131884
PCT Pub. Date: Jul. 1, 2021

(65) Prior Publication Data

US 2022/0403575 A1 Dec. 22, 2022

(30) Foreign Application Priority Data

Dec. 26, 2019 (JP) ..... 2019-236471

(51) Int. Cl.
*D05C 11/06* (2006.01)
*D05C 7/08* (2006.01)

(52) U.S. Cl.
CPC ..... *D05C 11/06* (2013.01); *D05C 7/08* (2013.01)

(58) Field of Classification Search
CPC ..... D05C 11/06; D05C 11/00; D05C 7/08; D05C 3/02; D05B 3/12; D05B 3/22; D05B 21/002; D05B 29/08; D05B 35/06
See application file for complete search history.

(56) References Cited

U.S. PATENT DOCUMENTS 1,852,952 A * 4/1932 Chudner ..... D05B 29/00 112/151
2,067,340 A * 1/1937 Prazak ..... D05B 35/06 112/100

(Continued)

FOREIGN PATENT DOCUMENTS

DE 102013105115 A1 12/2014
JP 2008302070 A 12/2008

(Continued)

OTHER PUBLICATIONS

International Search Report issued in Intl. Appln. No. PCT/JP2020/046654 mailed Mar. 9, 2021. English translation provided.

(Continued)

*Primary Examiner* — Ismael Izaguirre
(74) *Attorney, Agent, or Firm* — ROSSI, KIMMS & McDOWELL LLP

(57) ABSTRACT

The sewing machine is configured to prevent a string-shaped material from catching on a nearby component part thereof. A guide member for guiding the string-shaped material toward a sewing position reciprocates in a lateral direction to sew the string-shaped material to a sewing workpiece through zigzag stitching. A restriction member is disposed close to the guide member and has a laterally elongated section having a length corresponding to a range of reciprocation of the guide member. The string-shaped material extending from the guide member to the sewing position is positioned to be located beneath the laterally elongated section of the restriction member. With the presence of the laterally elongated section, when the guide member reciprocates, the string-shaped material being swung left and right by the guide member is reliably positioned (restricted) beneath the laterally elongated section. The restriction member may function as a presser foot too.

10 Claims, 5 Drawing Sheets

(56) References Cited

U.S. PATENT DOCUMENTS

| | | | | | |
|---|---|---|---|---|---|
| 2,358,689 | A | * | 9/1944 | Dasher | A41D 27/22 112/105 |
| 2,500,211 | A | * | 3/1950 | Sigoda | D05B 19/00 112/98 |
| 2,586,936 | A | * | 2/1952 | Goldstein | D05B 29/06 112/235 |
| 2,773,462 | A | * | 12/1956 | Seaman | D05B 35/06 112/100 |
| 2,819,696 | A | * | 1/1958 | Donaldson, Jr. | D05B 93/00 112/475.01 |
| 3,326,160 | A | * | 6/1967 | Murino | D05B 29/12 112/240 |
| 2008/0302287 | A1 | | 12/2008 | Kaisha | |

FOREIGN PATENT DOCUMENTS

| | | | |
|---|---|---|---|
| JP | 2010035990 | A | 2/2010 |
| JP | 2010075383 | A | 4/2010 |
| JP | 5302728 | B2 | 10/2013 |
| JP | 2017099821 | A | 6/2017 |

OTHER PUBLICATIONS

Written Opinion issued in Intl. Appln. No. PCT/JP2020/046654 mailed Mar. 9, 2021.

International Preliminary Report on Patentability issued in Intl. Appln. No. PCT/JP2020/046654 mailed Jan. 11, 2022.

English translation of International Preliminary Report on Patentability issued in Intl. Appln. No. PCT/JP2020/046654 mailed Jan. 11, 2022, previously cited in IDS filed May 24, 2022.

* cited by examiner

SEWING MACHINE

TECHNICAL FIELD

The present invention relates to sewing machines capable of sewing a string-shaped material, such as a tape or a cord, to a sewing workpiece (base fabric), such as a cloth.

BACKGROUND

Heretofore, there have been known sewing machines capable of sewing a string-shaped material, such as a tape or a cord, to a sewing workpiece by feeding the string-shaped material to a needle entry position while zigzag-swinging the string-shaped material. Patent Literatures 1 and 2 set forth below each disclose an embroidery sewing machine provided with an embroidery head capable of performing so-called zigzag stitching. In the embroidery sewing machine disclosed in Patent Literature 1, a machine head includes: a needle bar that has a sewing needle provided on a lower end portion thereof and that is driven in an up-down direction; a fabric pressing member or presser foot that is driven in the up-down direction at predetermined timing in response to the up-and-down movement of the needle bar; a rotation member mounted concentrically with the needle bar and rotatable about the axis of the rotation member; and a guide member swingably mounted to the rotation member via a lever pin, and a string-shaped material supplied from a bobbin is passed through the guide member, which swings in a left-right direction (namely, in a lateral direction), to be fed to the needle entry position of the sewing needle. Further, in the embroidery sewing machine disclosed in Patent Literature 2, a machine head is constructed in such a manner that a guide member is slid horizontally in a left-right direction along a guide rail via a swing member that is swingably mounted via a lever pin, and a string-shaped material supplied from a bobbin is passed through a guide member, which is moved horizontally, to be fed to a needle entry position of a sewing needle.

In the embroidery sewing machines provided with such machine heads, sewing-progressing directions relative to the sewing workpiece are calculated on the basis of predetermined sewing data and the string-shaped material is fed to the needle entry position of the sewing needle while being zigzag-swung in a predetermined pattern, by the guide member being swung in the left-right direction or horizontally moved while direction control is being performed on the rotation member in such a manner that the lever pin is always located ahead in the sewing-progressing directions. In this manner, the string-shaped material is sewn to the sewing workpiece through lock stitching with the needle bar and the presser foot driven in the up-down direction.

Further, in recent years, such sewing machines have been used for preform molding of a fiber-reinforced composite material, as well as for sewing a decorative string-shaped material to a sewing workpiece. Patent Literature 3 set forth below discloses an example of such preform molding. More particularly, Patent Literature 3 discloses a method for sewing a string-shaped material, formed of reinforcing fibers such as carbon fibers and glass fibers, to a sewing workpiece (base fabric) by use of an embroidery sewing machine constructed similarly to the aforementioned sewing machines provided with machine heads capable of performing zigzag stitching. The carbon fibers and glass fibers mainly used as the reinforcing fibers are forms of products called "tows", "rovings", and the like each formed generally as a bundle of one thousand to several tens of thousands thin single fibers that each have a diameter of a few microns and that are gathered together in a uniform direction. In the sewing machine disclosed in Patent Literature 3, the tow (or roving) is wound on a small-sized bobbin pivoting around the needle bar or on a bobbin provided above the machine head, and such a tow (or roving) is passed through the guide member and then fed to the needle entry position of the sewing needle.

PRIOR ART LITERATURE

Patent Literature

Patent Literature 1: Japanese Patent Application Laid-open Publication No. 2008-302070

Patent Literature 2: Japanese Patent No. 5302728

Patent Literature 3: German Patent Application Publication No. DE102013105115

The conventionally known presser foot of the sewing machine functions to assist in achieving stabilized sewing by pressing an area of the sewing workpiece around a needle drop position during the sewing. Because a bottom portion of the conventionally known presser foot only has to have a size sufficient for performing the sewing-workpiece pressing function, the size of the bottom portion is not so large. However, when the string-shaped material is swung in the left-right direction by the guide member for zigzag stitching, the width over which the string-shaped material is swung leftward and rightward may exceed the size of the bottom portion of the presser foot. In such a case, the string-shaped material, swung in the left-right direction, positionally deviates from a string-shaped material covering area of the bottom portion of the presser foot in the left-right direction as viewed in plan view, and thus, the swung string-shaped material may interfere with (or catch on) the presser foot moving in the up-down direction. Normally, in a case where a stroke of the up-and-down movement of the presser foot is of an ordinary length (namely, relatively long), the guide member is swung leftward and rightward (in the lateral direction) at timing when the presser foot has been moved upward over a relatively long distance, and thus, the string-shaped material, such as a tow (long fiber bundle), leading from the guide member to the sewing workpiece (base fabric) will not interfere with (catch on) the presser foot. If the up-and-down movement stroke of the presser foot is made shorter, however, there can arise a problem of the string-shaped material interfering with (catching on) the presser foot. Namely, as the up-and-down movement stroke length of the presser foot is made shorter, the string-shaped material leading from the guide member to the base fabric may more easily positionally deviate from the bottom portion of the presser foot to go up off the bottom portion of the presser foot, and thus more easily catches on a side surface of the presser foot or an edge or the like of the bottom portion of the presser foot, when the string-shaped material is swung in the left-right direction.

Particularly, in order to prevent poor or defective thread tightening caused by flapping of the base fabric (namely, uplifting of the base fabric caused by an upper thread at the time of thread tightening) and improve thread tightening quality without increasing tension of the upper thread, it is desirable to reduce the up-and-down movement stroke of the presser foot as short as possible. However, if the up-and-down movement stroke of the presser foot is reduced, there can arise the problem of the string-shaped material interfering with (catching on) the presser foot, as noted above. Particularly, with a sewing machine employing the construction disclosed in Patent Literature 1, when tows (long fiber bundles) are sewn to a base fabric in a plurality of layers, it is necessary to adjust in advance the guide member to a relatively high position in anticipation of a layered height of the tows with a view to avoiding the guide member from interfering with the layered tows. However, in such a case, a tilt angle of the tows (long fiber bundles) leading from the guide member to the base fabric becomes large (namely, the tows take a more upright posture), and thus, the problem of the tows catching on the presser foot becomes more serious.

SUMMARY

In view of the foregoing prior art problems, it is one of the objects of the present invention to provide a sewing machine that prevents a string-shaped material, swung in a lateral direction via a guide member, from catching on a nearby component part (particularly, a presser foot) of the sewing machine.

In order to accomplish the aforementioned object, the present invention provides a sewing machine capable of sewing a string-shaped material to a sewing workpiece, which includes: a guide member for guiding the string-shaped material toward a sewing position; a reciprocation mechanism for reciprocatingly moving the guide member in a lateral direction; and a restriction member disposed close to the guide member and having a laterally elongated section, the laterally elongated section having a length corresponding to a range of reciprocating movement of the guide member.

According to the present invention, the laterally elongated section of the restriction member has a length corresponding to the range of reciprocating movement of the guide member. Therefore, when the guide member is reciprocatingly moved, a portion of the string-shaped material extending from the distal end of the guide member downward to the sewing position located below the distal end of the guide member can be reliably positioned (restricted) beneath the laterally elongated section (in such a manner that unwanted upward movement of the string-shaped material can be restricted or suppressed by the laterally elongated section). Thus, when the string-shaped material is swung in the lateral (left-right) direction, the string-shaped material can be prevented from catching on a nearby component part or portion (particularly, a presser foot, or a side surface or the like of the restriction member in a case where the restriction member itself functions also as the presser foot). Namely, even where an up-and-down movement stroke of the presser foot (or an up-and-down movement stroke of the restriction member in the case where the restriction member itself functions also as the presser foot) is small, the string-shaped material can be reliably restricted to be located beneath the laterally elongated section of the restriction member without positionally deviating from a string-shaped material covering area of the laterally elongated section, and hence, the string-shaped material can be reliably prevented from catching on the presser foot (or the restriction member).

BRIEF DESCRIPTION OF DRAWINGS

FIG. 6 is an FIGS. 6A and 6B are enlarged plan views of the guide member and the restriction member illustrating different operational states when the guide member is reciprocatingly moved, of which

DETAILED DESCRIPTION

Figure 1:
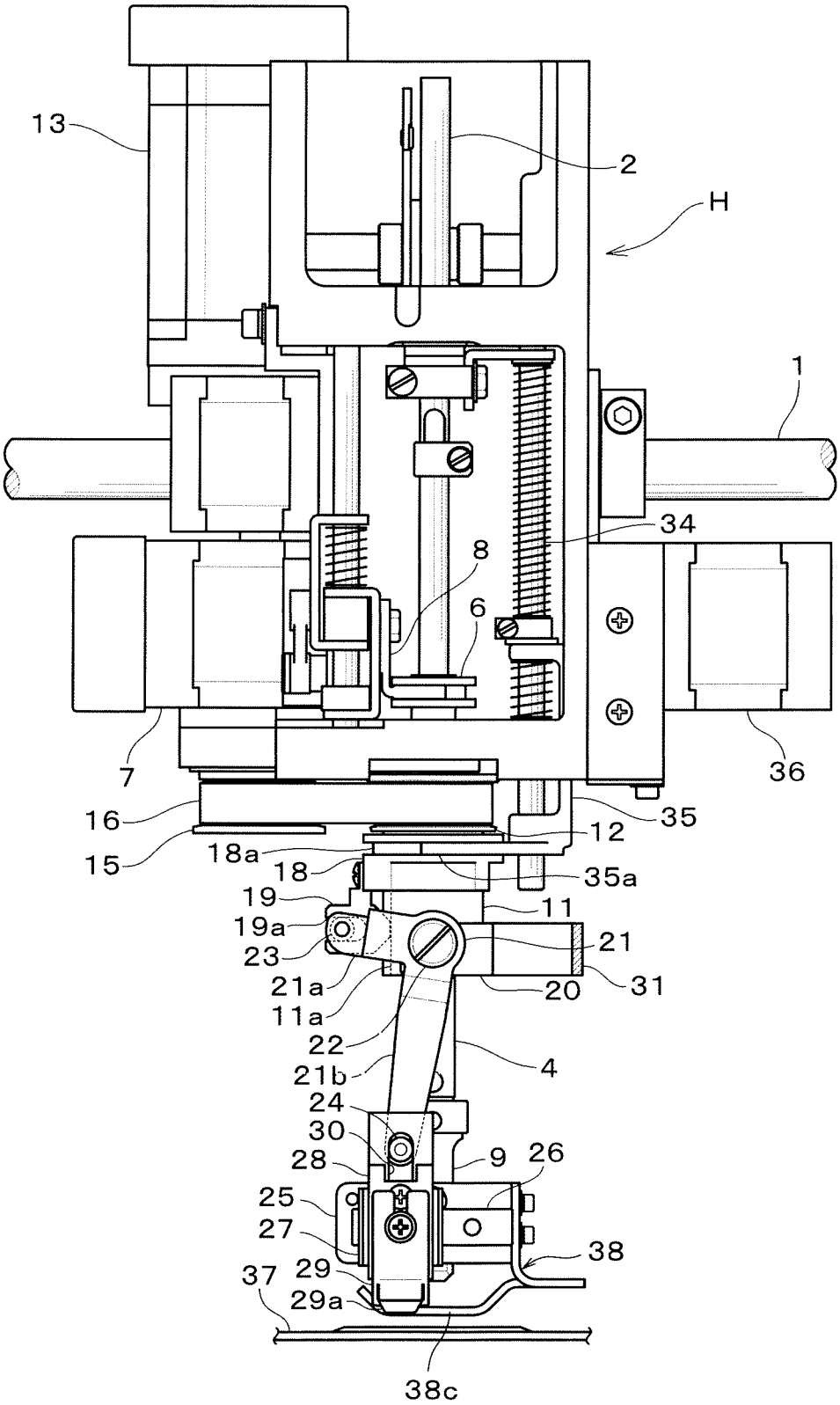
FIG. 1 is a front view illustrating an embodiment of a sewing machine of the present invention, which more particularly illustrates one machine head in the sewing machine of the present invention.
Figure 2:
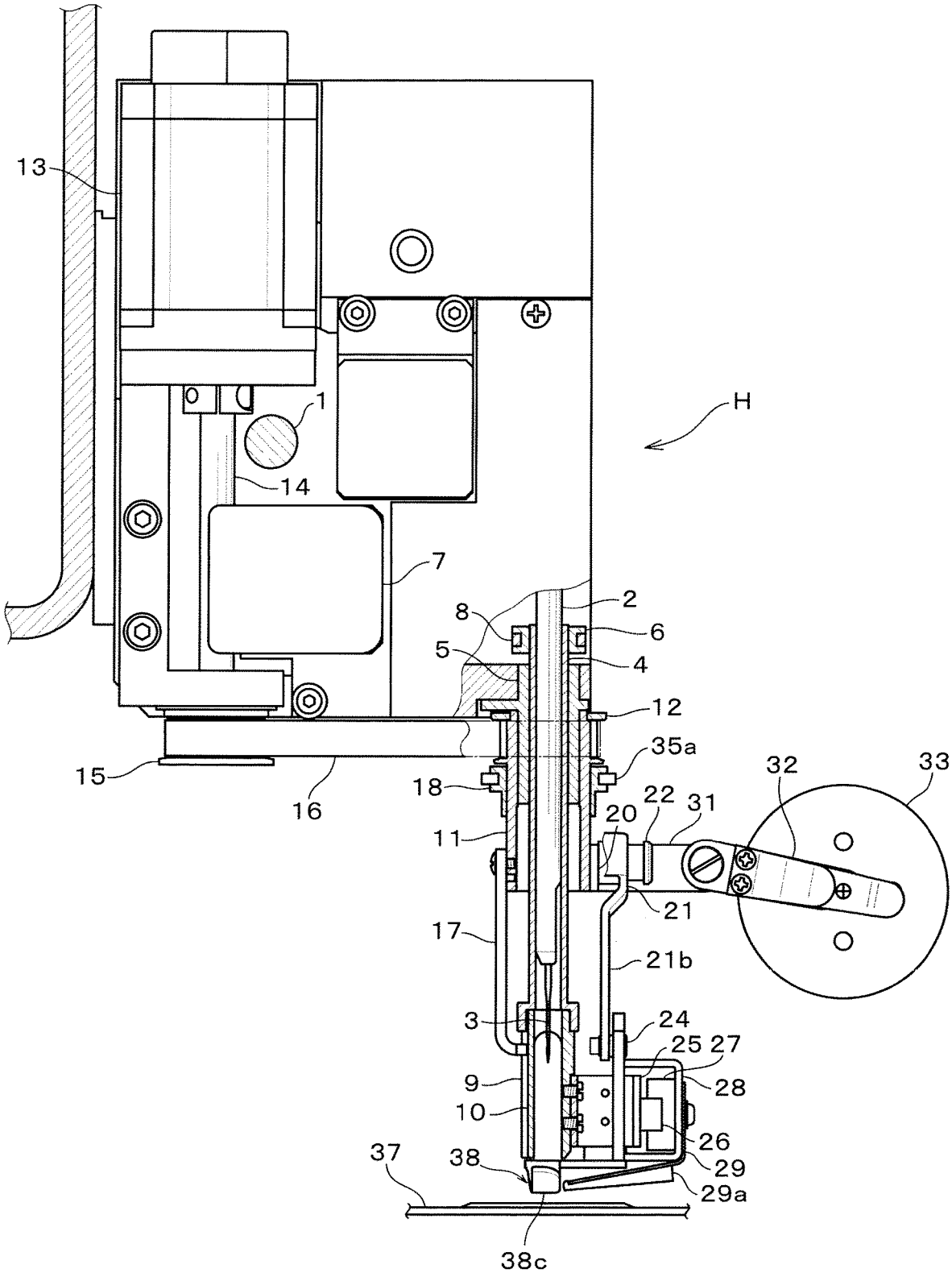
FIG. 2 is a partly broken-away side view of the machine head of FIG. 1.

FIG. 1 is a front view illustrating an embodiment of a sewing machine of the present invention, which more particularly illustrates one machine head H in the sewing machine of the present invention, and FIG. 2 is a partly broken-away side view of the machine head H illustrated in FIG. 1. A plurality of such machine heads H, rather than just one machine head H, may be provided in the inventive sewing machine. A needle bar 2 is provided in the machine head H in such a manner that the axis of the needle bar 2 extends in an up-down direction (vertical direction). The needle bar 2 is reciprocatingly driven in the up-down direction by rotation of a main shaft 1 of the sewing machine. A sewing needle 3 is attached to a lower end portion of the needle bar 2. A support cylinder 4 is mounted around the outer periphery of the needle bar 2, and this support cylinder 4 is capable of moving up and down relative to the needle bar 2 and rotating about the axis of the needle bar 2 while being guided along the inner circumferential surface of a fixed sleeve 5 fixed to a lower portion of the machine head H. Further, an engaging ring 6 is fixed to the outer circumference of an upper end portion of the support cylinder 4, and a drive arm 8 movable in the up-down direction by being driven by a motor 7 is held in engagement with the engaging ring 6.

A support 9 is fixed to the lower end of the support cylinder 4. The support 9 has a lower end section formed in a bifurcated shape, and a key groove 10 extending in the upright direction is formed in an outer side surface of one of leg portions of the bifurcated lower end section of the support 9. A rotation cylinder 11 is mounted on the outer circumference of the fixed sleeve 5. The rotation cylinder 11 is mounted around and concentrically with the needle bar 2 and only rotatable about the axis of the needle bar 2. A timing pulley section 12 is formed on the outer circumference of an upper end portion of the rotation cylinder 11, and a timing belt 16 is wound on and extends between the timing pulley section 12 and a drive pulley 15 fixed to a rotation shaft 14 of a motor 13. Thus, as the motor 13 is driven to rotate the drive pulley 15, the rotation cylinder 11 is rotated via the timing belt 16 and the timing pulley section 12. A key member 17 engaging with the key groove 10 of the support 9 is fixed to the lower end of the rotation cylinder 11. With such arrangements, the support 9 not only moves up and down as the support cylinder 4 moves up and down but also rotates about the axis of the needle bar 2 as the rotation cylinder 11 rotates.

Figure 3:
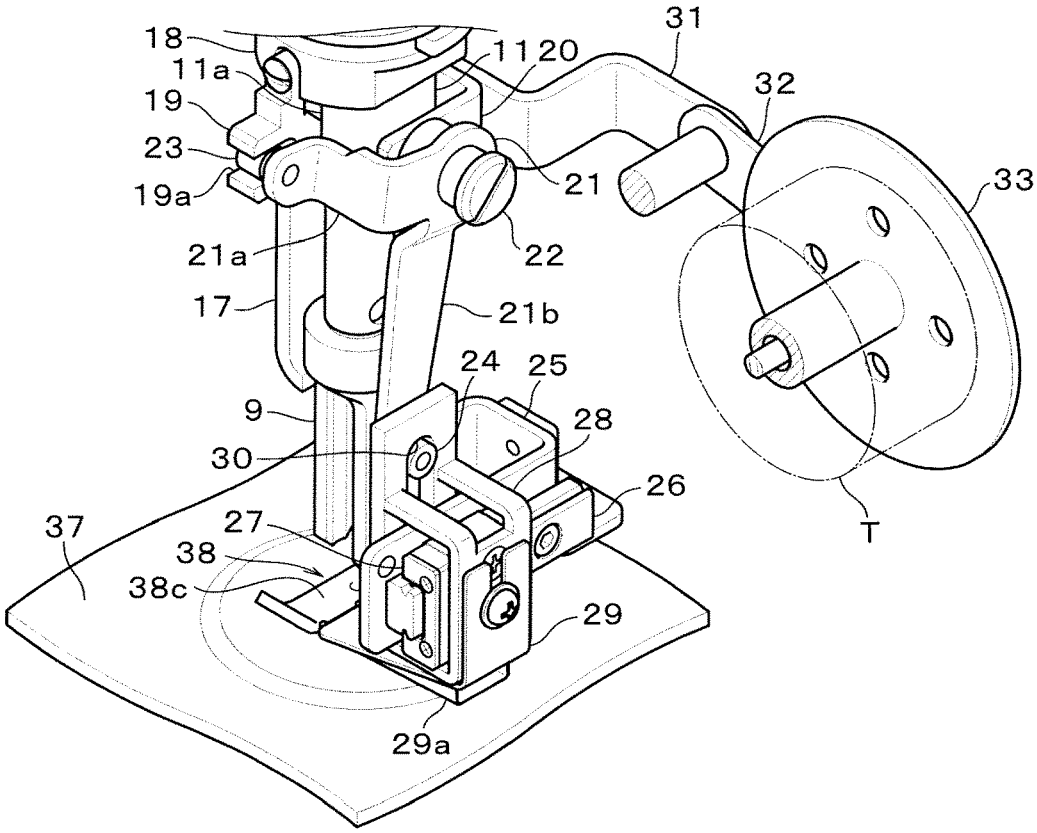
FIG. 3 is an enlarged perspective view illustrating a lower section of the machine head of FIG. 1.

FIG. 3 is a somewhat enlarged perspective view illustrating a lower section of the machine head H of FIGS. 1 and 2. As clear also from FIGS. 2 and 3, an interlocking member 18 is fitted over the outer circumference of the rotation cylinder 11 in such a manner that the interlocking member 18 is movable in the up-down direction and rotatable. A connection piece 19 is fixed to the interlocking member 18 and held in engagement with an engaging groove 11*a* formed in the outer circumference of the rotation cylinder 11. Thus, the interlocking member 18 is rotatable together with the rotation cylinder 11 as the rotation cylinder 11 rotates. Further, a swing lever 21 is mounted to the rotation cylinder 11 via a bracket 20. The swing lever 21 is mounted in such a manner that the lever 21 is swingable, about a lever pin 22 mounted to an outer side surface of the bracket 20, leftward and rightward of the axis of the needle bar 2 relative to the rotation cylinder 11. The swing lever 21 has one arm portion 21*a* extending laterally from a portion adjoining the lever pin 22 and another arm portion 21*b* extending downward from the portion adjoining the lever pin 22. A roller 23 is mounted to the distal end of the laterally extending arm portion 21*a*, and the roller 23 is held in engagement in a linking groove 19*a* of the connection piece 19. A roller 24 is mounted to the distal end of the downwardly extending arm portion 21*b*.

A support member 25 having a generally U shape (or a generally U angle-like shape) as viewed in plan is fixed to the support 9. The support 9 is coupled with one arm of the support member 25, and a guide rail 26 is fixed to the other arm (located opposite from the one arm) of the support member 25. Further, a restriction member 38 is mounted to a mounting portion of the support member 25 between the two arms, as described in detail later. A slider 27 is provided on the guide rail 26 in such a manner that the slider 27 is slidingly movable in the lateral direction. A guide member 29 is fixed to the slider 27 via a bracket 28 formed in a U shape. The guide member 29 is, for example, in the form of a plate spring and flexible in the up-down direction with a fixed portion of the guide member 29, which is fixed to the bracket 28, functioning as a flexibly bending base. The bracket 28 has a fitting groove 30 formed in its surface opposed to the swing lever 21, and the roller 24 of the swing lever 21 is fitted in the fitting groove 30. A guide tube 29*a* for passing therethrough the string-shaped material T to feed the string-shaped material T to a needle entry position (namely, a sewing position) of the sewing needle 3 is provided at the lower end of the guide member 29. Further, a bobbin bracket 32 is fixed to an outer circumferential portion of the rotation cylinder 11 via the bracket 20 and an arm member 31, and a bobbin 33 having the string-shaped material T wound thereon is rotatably supported on the bobbin bracket 32. The string-shaped material T pulled out from the bobbin 33 is passed through the guide tube 29*a* to extend downward from the distal end of the guide tube 29*a* and is then placed on the base fabric (namely, the sewing workpiece) (not illustrated in the drawings) laid on a needle plate 37.

As conventionally known, in embroidering sewing machines, an embroidery frame (not illustrated in the drawings) holding thereon a base fabric (sewing workpiece) is driven two-dimensionally per stitch in accordance with a desired sewing pattern. Thus, the base fabric (sewing workpiece) is moved relative to the machine head H. In order to sew the string-shaped material T to the base fabric (sewing workpiece) in accordance with the sewing pattern, the driving of the motor 13 is controlled in accordance with a sewing-progressing direction, the rotation cylinder 11 is rotated in response to the driving of the motor 13, and the lever pin 22 is controlled to rotate around the needle bar 2 in such a manner as to be oriented in the sewing-progressing direction. Thus, the guide member 29 is controlled to rotate around the needle bar 2 in such a manner that the distal end of the guide member 29, namely, the distal end of the guide tube 29*a*, is always oriented toward the center of the needle bar 2. In this manner, the string-shaped material T extending out from the distal end of the guide member 29, namely, from the distal end of the guide tube 29*a*, is directed or guided toward the sewing position (needle entry position). In this manner, the guide member 29 performs a function of guiding the string-shaped material T toward the sewing position, and the aforementioned elements 13, 11, 22, etc. related to the string-shaped material guiding function as a device and/or a mechanism that controls a basic string-shaped material guiding direction of the guide member 29.

A type, shape, etc. of the string-shaped material T are determined appropriately in accordance with a purpose of a sewn product that is to be finished by use of the inventive sewing machine. For example, in a case where a decorative string-shaped material T is to be sewn to a sewing workpiece (not illustrated in the drawings), a tape, a string, or a cord having a color, a size, and an outer shape (flat or somewhat round outer shape) suited for a desired decoration purpose is used as the string-shaped material T. Further, in a case where a tow (long fiber bundle) that functions as reinforcing fibers for preform molding of a fiber-reinforced composite material is to be sewn to a sewing workpiece (not illustrated), the tow that functions as reinforcing fibers is used as the string-shaped material T. In such a case, the string-shaped material T is formed of carbon fibers, glass fibers, aramid fibers, boron fibers, xyron fibers, and/or the like, as the reinforcing fibers for making the preform (interim product made by pre-processing the reinforcing fibers into a shape close to a shape of a molded product), and the string-shaped material T in this case is a long belt-shaped fiber bundle called "tow", "roving" or "filament". Alternatively, the string-shaped material T may be a composite material formed by half-impregnating a reinforcing fiber bundle with a resin, a composite material formed by combining carbon fibers and resin fibers (commingled yarn), or a fiber bundle formed by roving chemical fibers and/or the like into a belt shape. Note that the guide tube 29*a* in the illustrated example has an elongated rectangular cross-sectional shape and is suited for a wide, flat string-shaped material T (such as a flat tow material).

As illustrated in FIG. 1, a guide shaft 34 is disposed adjoining the needle bar 2 in such a manner that the axis of the shaft 34 extends in the up-down direction. A lifting and lowering member 35 is mounted on the guide shaft 34. The lifting and lowering member 35 is movable up and down along the axis of the guide shaft 34 while being guided by the shaft 34, by rotational driving force of a zigzag swinging motor 36 being transmitted to the member 35 via a not-illustrated drive transmission mechanism. The lifting and lowering member 35 has a fork portion 35*a* projecting substantially horizontally toward the needle bar 2, and this fork portion 35*a* is held in engagement with a groove portion 18*a* formed in the outer periphery of the interlocking member 18. Thus, as the interlocking member 18 and the connection piece 19 move up and down in response to the up-and-down movement of the lifting and lowering member 35, the up-and-down movement of the connection piece 19 is converted into swinging movement of the swing lever 21 via the linking groove 19*a* and the roller 23. In response to the swinging movement of the swing lever 21, the roller 24 of the arm portion 21*b* fitted in the fitting groove 30 of the bracket 28 also swings, so that the bracket 28 and the guide member 29 fixed to the slider 27 via the bracket 28 reciprocatingly move straight or linearly leftward and rightward (in the lateral direction) with respect to a sewing-progressing direction as the slider 27 slides along the guide rail 26. Although the swinging movement (reciprocating movement) of the roller 24 contains some vertical component as well as a horizontal component, such a vertical component of the swinging movement of the roller 24 is not transmitted to the bracket 28 because the roller 24 is freely movable up and down along the fitting groove 30. In this manner, only the horizontal component of the swinging movement of the roller 24 is transmitted to the bracket 28, so that the guide member 29 is reciprocatingly moved linearly in the horizontal direction. It should be noted that in this description, the term "lateral direction" or "left-right direction" refers to a direction of the reciprocating movement of the guide member 29 (direction of reciprocating movement of the horizontal component).

As well known, the zigzag swinging motor 36 is driven to sew the string-shaped material T to the basic fabric (sewing workpiece) through zigzag swing stitching (zigzag stitching). Namely, although the sewing-progressing direction, in which the string-shaped material T is to be sewn to the basic fabric, is controlled via the aforementioned motor 13, the sewing of the string-shaped material T through the zigzag swing stitching (zigzag stitching) is controlled via the zigzag swinging motor 36. The aforementioned elements 36, 34, 35, 35*a*, 19, 18, 23, 21, 28, 27, 26, etc. together function to zigzag-swing the string-shaped material T; in other words, these elements together function as a reciprocation mechanism for reciprocatingly moving the guide member 29 in the lateral direction.

Figure 4:
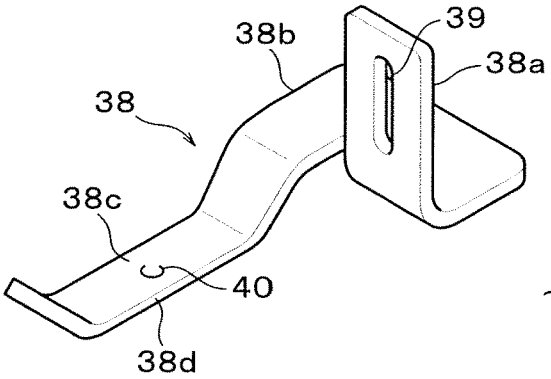
FIG. 4 is an enlarged perspective view illustrating a restriction member provided in the lower section of the machine head of FIG. 1.

As illustrated in FIGS. 1 to 3, the restriction member 38 is provided close to the guide member 29. More specifically, the restriction member 38 is mounted to the mounting portion between the two arms of the support member 25. FIG. 4 is an enlarged perspective view of the restriction member 38. The restriction member 38 includes a fixing section 38*a* having an elongated hole 39, and the restriction member 38 is fixed to the mounting portion of the support member 25 by a screw inserted in the elongated hole 39. The restriction member 38 also includes a support section 38*b* extending leftward from a lower portion of the fixing section 38*a*. The restriction member 38 further includes a restriction section 38*c* extending laterally at a position lower than the support section 38*b*. The restriction section 38*c* is formed as a laterally elongated section extending in the reciprocating movement direction of the guide member 29 (namely, in the lateral direction). As an example, the restriction section (namely, laterally elongated section) 38*c* is provided at the lower end of the restriction member 38 and constitutes a flat surface parallel to the upper surface of the needle plate 37. Of course, the flat surface of the restriction section (namely, laterally elongated section) 38*c* need not necessarily be precisely flat and may have appropriate, slight unevenness. Note that in the illustrated example of FIG. 4, a distal end portion of the restriction section 38*c* is somewhat curved upward in such a manner that the distal end portion can be prevented from catching on the base fabric or the like when the restriction section 38*c* is lowered to its lowest position.

Figure 5:
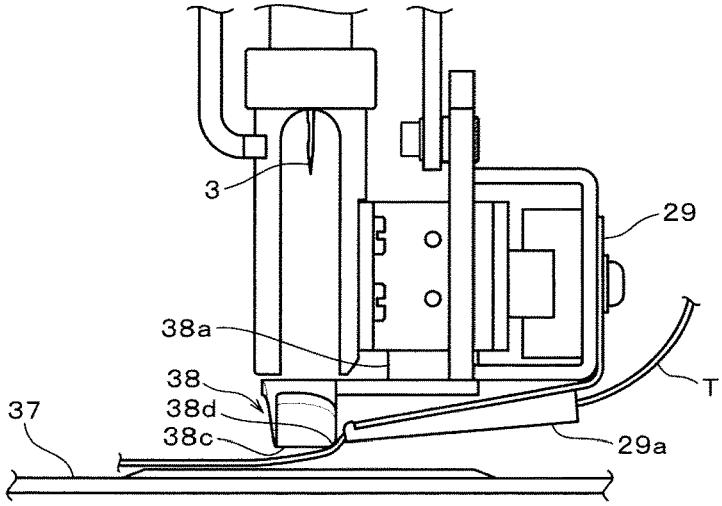
FIG. 5 is an enlarged side view illustrating a guide member and the restriction member provided in the lower section of the machine head of FIG. 1.

FIG. 5 is a side view illustrating a positional relationship between the restriction section (laterally elongated section) 38*c* of the restriction member 38 and the guide member 29. The restriction member 38 is disposed close to the guide member 29, without contacting the guide member 29, in such a manner that a side edge 38*d* of the restriction section (laterally elongated section) 38*c* is substantially opposed to the guide member 29. Namely, the restriction member 38 is disposed in such a manner that the restriction section (laterally elongated section) 38*c* is located close to the distal end of the guide member 29 (namely, the distal end of the guide tube 29*a*). Further, a portion of the string-shaped material T extending from the guide member 29 to the sewing position is positioned to be located beneath the restriction section (laterally elongated section) 38*c* of the restriction member 38.

A height of the restriction section 38*c* relative to the support member 25 (namely, relative to the guide member 29) can be adjusted by adjusting, via the screw, a fixed position of the fixing section 38*a* relative to the support member 25 along the elongated hole 39. In this way, it is possible to adjust a height relationship between the restriction section (laterally elongated section) 38*c* and the distal end of the guide member 29 (namely, the distal end of the guide tube 29*a*). In this embodiment, the restriction section (laterally elongated section) 38*c* provided at the lower end of the restriction member 38 functions also as a fabric pressing member or a presser foot during a sewing operation. Namely, the driving of the aforementioned motor 7 (FIG. 1) is controlled in synchronism with the up-and-down movement of the needle bar 2 during the sewing operation, in response to which the restriction member 38 is moved up and down via the drive arm 8, the engaging ring 6, the support cylinder 4, the support 9, and the support member 25 (see FIGS. 1, 2, and the like for details of these elements), so that the restriction section (laterally elongated section) 38*c* provided at the lower end of the restriction member 38 can be caused to function as the presser foot. As illustrated in FIG. 4, a needle passage hole or opening 40 for enabling passage therethrough of the sewing needle 3 is formed in the restriction section (laterally elongated section) 38*c* provided at the lower end of the restriction member 38. In this way, the restriction section (laterally elongated section) 38*c* can be caused to function as the presser foot at a needle drop position of the sewing needle 3. In the case where the restriction section (laterally elongated section) 38*c* of the restriction member 38 is to be caused to function also as the presser foot as noted above, the height of the restriction member 38 may be adjusted in such a manner that the lower surface of the restriction section (laterally elongated section) 38*c* is located appropriately lower than the lower surface of the guide tube 29*a* as illustrated in FIG. 5. The aforementioned elements 38*a*, 39, the screw, and the like together function as a position adjusting mechanism for adjusting the height position of the restriction member 38. The guide member 29 is supported on the support member 25 in such a manner that the member 29 is slidable in the lateral direction as set forth above. Thus, as the restriction member 38 fixed to the support member 25 is moved up and down in response to the driving of the motor 7, the guide member 29 is moved up and down together with the restriction member 38. Note that in a case where the restriction section (laterally elongated section) 38*c* is not to be caused to function as the presser foot (namely, where an appropriate presser foot is provided separately), the restriction section (laterally elongated section) 38*c* need not necessarily be provided at the lower end of the restriction member 38, and besides, the needle passage hole 40, too, may be omitted.

Figure 6A:
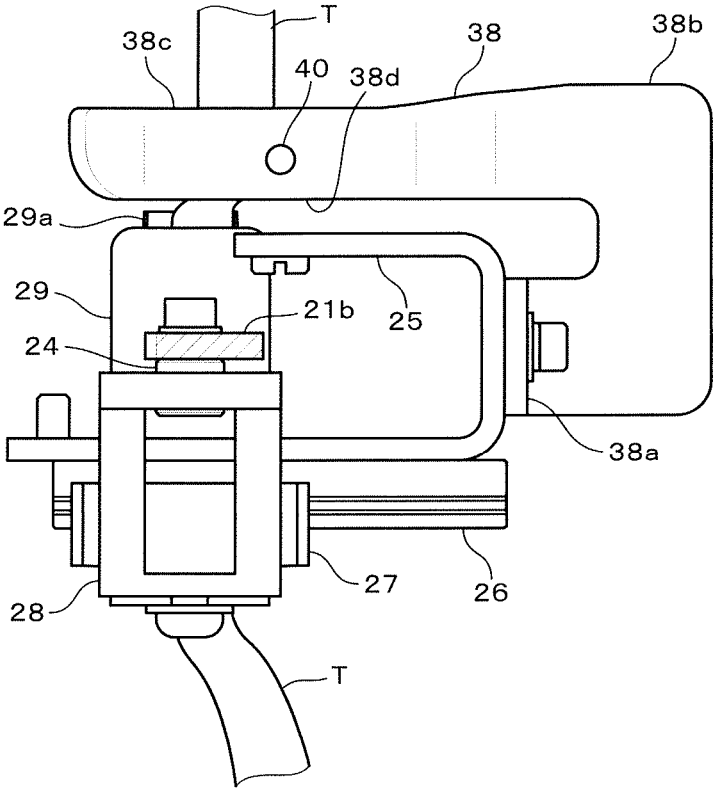
FIG. 6A illustrates the state where the guide member is located at the leftmost end and FIG. 6B illustrates the state where the guide member is located at the rightmost end.
Figure 6B:
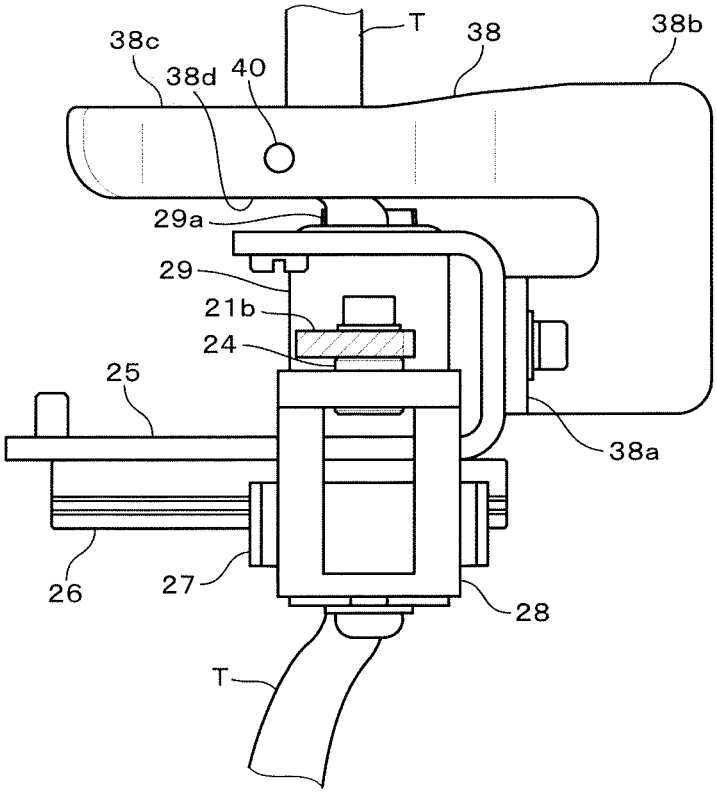

The restriction section (laterally elongated section) 38*c* has a length corresponding to a range of the reciprocating movement of the guide member 29. A specific example of such a corresponding relationship is illustrated in (a) and (b) of FIG. 6. (a) and (b) of FIG. 6 are each an enlarged plan view illustrating a specific example of the relationship between a lateral length of the restriction section (laterally elongated section) 38*c* and the range of the reciprocating movement of the guide member 29. More specifically, (a) of FIG. 6 is a plan view when the guide member 29 is located at the leftmost end of the reciprocating movement range, while (b) of FIG. 6 is a plan view when the guide member 29 is located at the rightmost end of the reciprocating movement range. As an example, the lateral length of the restriction section (laterally elongated section) 38*c* is almost equal to the reciprocating movement range of the guide member 29 (leftward/rightward movement range of the guide tube 29*a*). For example, as illustrated in (a) and (b) of FIG. 6, the length of the restriction section (laterally elongated section) 38*c* is such a dimension that when the guide member 29 is located at either one of the two ends (leftmost end or rightmost end) of the reciprocating movement range of the guide member 29, the entire lateral width of the string-shaped material T guided by the guide member 29 is covered or overlapped by the restriction section (laterally elongated section) 38*c* in an overlapped manner. However, the present invention is not so limited, and the length of the restriction section 38*c* may be such a dimension that when the guide member 29 is located at either one of the opposite ends (leftmost end or rightmost end) of the reciprocating movement range of the guide member 29, at least part of the lateral width of the string-shaped material T guided by the guide member 29 is covered with the restriction section (laterally elongated section) 38*c* in an overlapped manner. Namely, the length of the restriction section (laterally elongated section) 38*c* may be a dimension somewhat smaller than the reciprocating movement range of the guide member 29 such that part of the width of the string-shaped material T lies outside a string-shaped-material covering area of the bottom portion of the restriction section (laterally elongated section) 38*c* at the leftmost end or rightmost end of the reciprocating movement range of the guide member 29. As another alternative, the lateral length of the restriction section (laterally elongated section) 38*c* may be appropriately larger than the reciprocating movement range of the guide member 29 (leftward/rightward movement range of the guide tube 29*a*). Namely, in the present invention, examples of the aforementioned length of the restriction section (laterally elongated section) 38*c* corresponding to the reciprocating movement range of the guide member 29 include a length appropriately larger than the reciprocating movement range of the guide member 29.

Thus, when the guide member 29 is reciprocatingly moved as noted above, the portion of the string-shaped material T extending downward from the distal end of the guide member 29 to the sewing position can be reliably located beneath the restriction section (laterally elongated section) 38*c* of the restriction member 38 to contact (or to be at least covered with) the covering area of the lower surface of the restriction section (laterally elongated section) 38*c* (and thus, unwanted upward movement of the string-shaped material T can be restricted or suppressed). In this way, when the string-shaped material T is swung laterally (in the left-right direction), it is possible to reliably prevent the string-shaped material T from catching on a nearby component part or portion (particularly, the presser foot, or an edge portion or the like of the restriction member 38 in the case where the restriction member 38 is caused to function as the presser foot). Namely, even where the up-and-down movement stroke of the presser foot (or the up-and-down movement stroke of the restriction member 38 if the restriction member 38 is constructed to function also as the presser foot as in the present embodiment) is small, the string-shaped material T can be reliably positioned to be located beneath the restriction member 3 without largely positionally deviating from the string-shaped material covering area of the restriction section (laterally elongated section) 38*c*, and hence, the string-shaped material T can be reliably prevented from catching on the presser foot (restriction member 38).

Now, a description will be given about an example of a sewing operation for sewing the string-shaped material T to the base fabric (sewing workpiece) through lock stitching by the machine head H constructed in the above-described manner. First, the bobbin 33 having the string-shaped material T wound thereon is set on the bobbin bracket 32, and the string-shaped material T is paid out from the bobbin 33 and passed through the guide tube 29*a* to be led to the needle drop position (needle entry position) of the sewing needle 3. In this state, lock stitching is performed in the conventionally known manner, through the functions of the sewing needle 3 and a not-illustrated rotary hook, by moving the embroidery frame (not illustrated), holding the base fabric (sewing workpiece), in X-Y directions on the basis of predetermined embroidery data but also moving up and down the needle bar 2. During that time, the guide member 29 is reciprocatingly swung, by driving of the zigzag swinging motor 36, leftward and rightward between the leftmost end position illustrated in (a) of FIG. 6 and the rightmost end position illustrated in (b) of FIG. 6 at predetermined timing, so that the string-shaped material T having been led through the guide tube 29*a* to the drop position of the sewing needle 3 is swung leftward or rightward of the drop position of the sewing needle 3, for example, per reciprocating movement of the needle bar 2 (per stitch). In this manner, the string-shaped material T is sequentially sewn to the sewing workpiece through zigzag stitching.

During the sewing operation, in response to the rotation cylinder 11 being rotated by the driving of the motor 13, the lever pin 22 is controlled to be always located ahead in a relative advancing direction of the machine head H based on the movement of the embroidery frame. Further, in response to the driving of the motor 7, the restriction member 38 is moved up and down at predetermined timing relative to the up-and-down movement of the needle bar 2. During this time, the guide member 29 is moved up and down together with the restriction member 38 through the aforementioned arrangements. Note that when the sewing of the string-shaped material T has been completed (or when the sewing of the string-shaped material T is not to be carried out), the guide member 29 can be moved upward to a retracted position together the restriction member 38 by the driving of the motor 7.

Height setting/control of a bottom dead point of the restriction member 38, which is moved up and down by the driving of the motor 7, can be performed by setting a height of the bottom dead point of the restriction member 38, for example, via an operation panel in accordance with a thickness of the sewing workpiece and a type of the string-shaped material T in a manner similar to that of setting a bottom dead point of the presser foot. Further, because the guide member 29 is moved up and down together with the restriction member 38 as noted above, a height position of the guide member 29 is automatically changed in accordance with a change of the height of the bottom dead point of the restriction member 38.

In a case where string-shaped materials T in the form of bundles of long reinforcing fibers, such as carbon fibers and glass fibers, are to be sewn to a sewing workpiece (base fabric) in a plurality of layers, a height of the reinforcing fibers sewn increases each time a layer of the string-shaped material T is superimposed on the sewing workpiece (base fabric). In order to deal with such a height change, a new height of the bottom dead point of the restriction member 38 may be set via the operation panel per layer sewing step. In this manner, per layer sewing step, the height position of the guide member 29 is changed automatically in response to the height setting of the restriction member 38.

Figure 7:
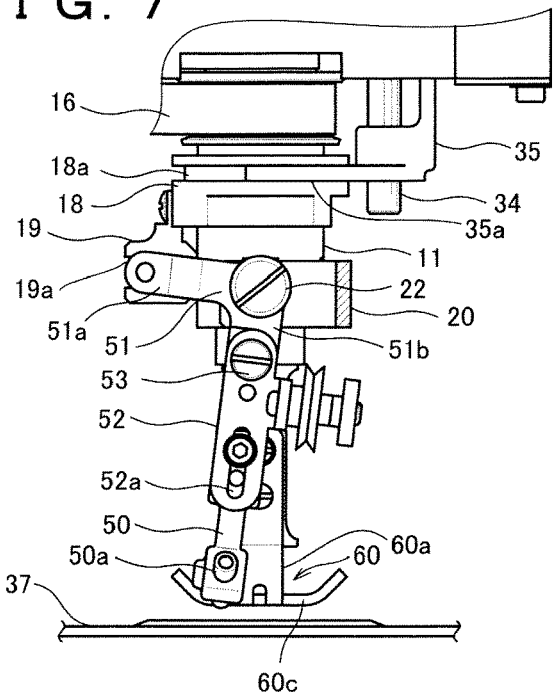
FIG. 7 is a front view illustrating another embodiment of the sewing machine of the present invention, which more particularly illustrates a lower section of one machine head in the other embodiment of the sewing machine.
Figure 8:
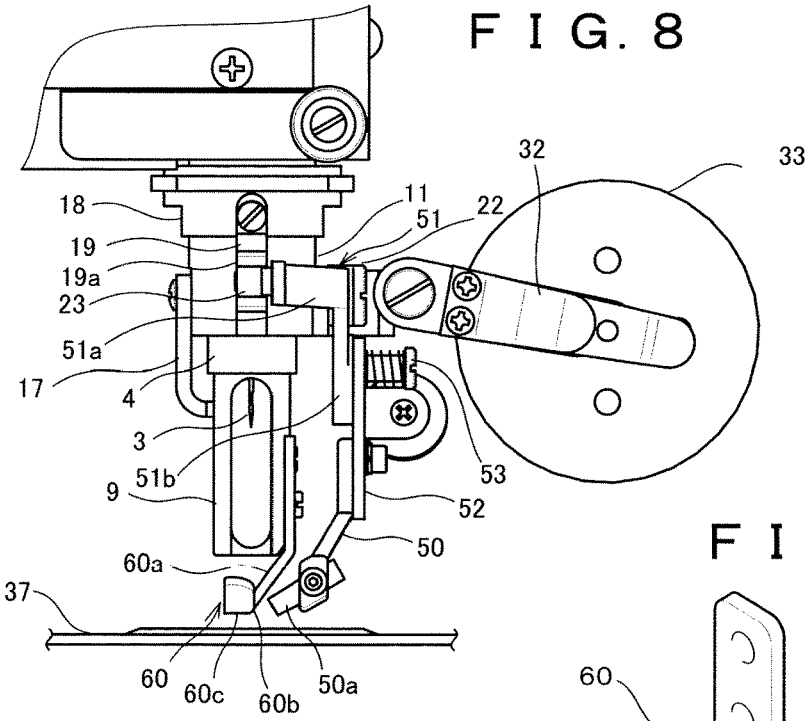
FIG. 8 is a side view of the lower section of the machine head of FIG. 7.

In the above-described embodiment of FIGS. 1 to 6, the reciprocation mechanism for reciprocatingly moving the guide member 29 in the lateral direction is constructed to reciprocatingly move the guide member 29 straight or linearly in the lateral direction. However, the present invention is not so limited, and the reciprocation mechanism may be constructed to swing the guide member 29 in the lateral direction. FIG. 7 is a front view illustrating a lower section of the machine head H, which more particularly illustrates another embodiment of the present invention that employs the reciprocation mechanism constructed to swing the guide member in the lateral direction, and FIG. 8 is a side view of the lower section of the machine head H illustrated in FIG. 7. In FIGS. 7 and 8, same reference characters as in FIGS. 1 to 6 denote elements of the same functions as the elements illustrated in FIGS. 1 to 6 and thus will not be described here to avoid unnecessary duplication. Further, elements and arrangements related to the reciprocation mechanism for swinging the guide member in the lateral direction are mainly illustrated in FIGS. 7 and 8, and other elements and arrangements not illustrated in FIGS. 7 and 8 are substantially similar to the elements and arrangements illustrated in FIGS. 1, 2, and the like.

In FIGS. 7 and 8, the interlocking member 18 is moved up and down via the lifting and lowering member 35 in response to the driving of the zigzag swinging motor 36 (FIG. 1) and is rotated together with the rotation cylinder 11, as set forth above. A swing lever 51 is mounted to the rotation cylinder 11 via the bracket 20. The swing lever 51 is mounted to the rotation cylinder 11 in such a manner that the lever 51 is swingable, relative to the rotation cylinder 11, leftward and rightward of the axis of the needle bar 2 about the lever pin 22 mounted to an outer side surface of the bracket 20. The swing lever 51 has one arm portion 51*a* extending laterally from a position adjoining the lever pin 22 and another arm portion 51*b* extending downward from a position adjoining the lever pin 22. The roller 23 is mounted to the distal end of the laterally extending arm portion 51*a*, and the roller 23 is held in engagement in the linking groove 19*a* of the connection piece 19.

The arm portion 51*b* of the swing lever 51 is connected to a guide member 50 via a connection member 52. A guide tube 50*a* for guiding the string-shaped material to the sewing position is mounted to the distal end of the guide member 50. Note that the guide member 50 in the illustrated example of FIGS. 7 and 8 has a generally round cross-sectional shape and hence is suited for string-shaped materials of a generally round cross-sectional shape or a small width. By adjusting a mounted position of the guide member 50 via an elongated hole 52*a* formed in the connection member 52, it is possible to adjust a height of the distal end of the guide member 50 (guide tube 50*a*) from the needle plate 37. Further, when the sewing of the string-shaped material is not to be carried out, the connection member 52 and the guide member 50 can be moved upward to a retracted position, by loosening a screw 53 fastening the connection member 52 to the arm portion 51*b* of the swing lever 51 and then causing the connection member 52 and the guide member 50 to pivot upward.

As the interlocking member 18 and the connection piece 19 is moved up and down in response to the driving of the zigzag swinging motor 36 (FIG. 1), the up-and-down movement of the connection piece 19 is converted into swinging movement of the swing lever 51 via the linking groove 19*a* and the roller 23. In response to the pivoting movement of the swing lever 51, the guide member 50 connected to the arm portion 51*b* of the lever 51 is swung in the left-right (lateral) direction. In this manner, the string-shaped material (not illustrated in FIGS. 7 and 8) passed through the guide tube 50*a* is swung in the lateral direction.

Figure 9:
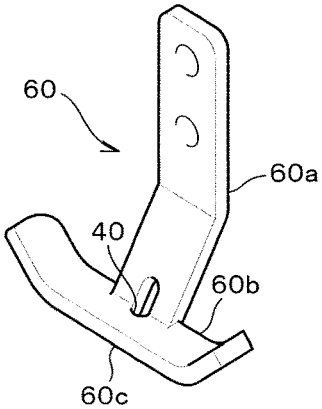
FIG. 9 is an enlarged perspective view illustrating a restriction member provided in the lower section of the machine head of FIG. 7.

In FIGS. 7 and 8, the support 9 not only moves up and down as the support cylinder 4 moves up and down but also rotates about the axis of the needle bar as the rotation cylinder 11 rotates, in the same manner as set forth above. A restriction member 60 is mounted to one of the lower end portions (namely, the lower end portion which the key member 17 is not engaged with) of the bifurcated support 9. FIG. 9 is an enlarged perspective view of the restriction member 60. The lower end of the restriction member 60 is formed as a laterally elongated restriction section (namely, a laterally elongated section) 60*c*. In this embodiment, a fixing section 60*a* extends upward from a substantially middle portion of a side edge 60*b* of the restriction section (laterally elongated section) 60*c*, and the restriction member 60 is screwed to the support 9 via the fixing section 60*a*. Like the aforementioned restriction section (laterally elongated section) 38*c*, the restriction section (laterally elongated section) 60*c* of the restriction member 60 has a length corresponding to a range of reciprocating movement of the guide member 50. Further, like the aforementioned restriction section (laterally elongated section) 38*c*, the restriction section (laterally elongated section) 60*c* of the restriction member 60 constitutes a flat surface parallel to the needle plate 37. Note that two distal end portions extending from the laterally opposite ends of the restriction section 60*c* are somewhat bent upward in such a manner that the distal end portions can be prevented from catching on the base fabric and/or the like when the restriction section 60*c* is lowered to its lowest position. Furthermore, the needle passage hole (opening) 40 for enabling passage therethrough of the sewing needle 3 is formed in the restriction section (laterally elongated section) 60*c*, and the restriction member 60 can function also as the presser foot. Note that a portion of the string-shaped material (not illustrated) extending from the guide member 50 to the sewing position is positioned to be located beneath the restriction section (laterally elongated section) 60*c* of the restriction member 60.

FIG. 7 illustrates a state where the guide member 50 has been swung to the leftmost end of the reciprocating movement (swinging movement) range of the member 50. It can be seen from FIG. 7 that when the guide member 50 is located at the leftmost end of the reciprocating movement (swinging movement) range, the entire width or part of the width of the sting-shaped material guided by the guide member 50 is covered or overlapped by the restriction section (laterally elongated section) 50*c*. It can also be seen from FIG. 7 that when the guide member 50 is located at the rightmost end of the reciprocating movement (swinging movement) range, too, the entire width or part of the width of the sting-shaped material guided by the guide member 50 is covered or overlapped by the restriction section (laterally elongated section) 50*c*. Namely, the lateral length of the restriction section (laterally elongated section) 60*c* is substantially equal to the length of the horizontal component of the reciprocating movement (swinging movement) range of the guide member 50 (swinging movement range of the guide tube 50*a*). Note that the lateral length of the restriction section (laterally elongated section) 60*c* of the restriction section 60 need not necessarily be precisely equal to the length of the horizontal component of the reciprocating movement (swinging movement) range of the guide member 50 (swinging movement range of the guide tube 50*a*) and may be appropriately longer or shorter than the latter.

With such arrangements, as the guide member 50 is reciprocatingly moved (swung), the portion of the string-shaped material (not illustrated) extending from the distal end of the guide member 50 downward to the sewing position below the guide member 50 can be reliably positioned beneath the restriction section (laterally elongated section) 60*c* in such a manner as to contact (or at least to be covered by) the lower surface of the restriction section (laterally elongated section) 60*c* (namely, in such a manner that unwanted upward movement of the string-shaped material can be restricted or suppressed by the lower surface of the restriction section 60*c*). In this way, when the string-shaped material is swung laterally (in the left-right direction), it is possible to reliably prevent the string-shaped material from catching on a nearby component part or portion (particularly, the presser foot, or a side surface of the restriction member 60 in this embodiment). Namely, even where the up-and-down movement stroke of the presser foot (or up-and-down movement stroke of the restriction member 60 in the case where the restriction member 60 itself functions also as the presser foot as in this embodiment) is small, the string-shaped material can be reliably restricted to be located beneath the restriction section 60*c* without positionally deviating from the string-shaped material covering area of the restriction section (laterally elongated section) 60*c*, and thus, the string-shaped material can be reliably prevented from catching on the presser foot (or the restriction member 60).

In the embodiment illustrated in FIGS. 7 and 8, although the guide member 50 and the restriction member 60 are rotated together about the axis of the needle bar in response to the rotation of the rotation cylinder 11, the guide member 50 is not moved up and down when the restriction member 60 is moved up and down in response to the up-and-down movement of the support 9. FIGS. 7 and 8 illustrate the restriction member 60 when the member 60 is, for example, at its top dead point, and the restriction member 60 is moved up and down between the top dead point and the bottom dead point lower than the top dead point.

Any of the above-described embodiments of the invention may be modified as follows. Namely, in the case where the restriction member 38 or 60 is not caused to function as the presser foot, an ordinary or conventional presser foot (not illustrated in the drawings) may be mounted to the lower end of the support 9, and the shape and position of the restriction section (laterally elongated section) 38*c* or 60*c* may be appropriately modified in such a manner as to not disturb the up-and-down movement of the needle bar 3 and the conventional presser foot. Note that in the case where the embodiment of FIG. 1 is modified as noted above, the height of the lower end of the restriction member 38 (restriction section or laterally elongated section 38*c*) may be set to be appropriately higher than the lower end of the conventional presser foot. Further, in the case where the embodiment of FIG. 7 is modified as noted above, the restriction member 60 may be dismounted or removed from the support 9 and then mounted, for example, to the bracket 20. In such a case, although the restriction member 60 is rotated together with the bracket 20 (namely, with the rotation cylinder 11 and eventually with the guide member 50), such rotation of the restriction member 60 is not linked to the up-and-down movement of the presser foot. As apparent from the foregoing, the scope of the present invention embraces the application where the restriction member 38 or 60 is not caused to function as the presser foot. However, if the sewing machine is constructed to enable the restriction member 38 or 60 to function also as the presser foot as noted above in relation to the above-described embodiments, the present invention achieves the advantageous benefit of simplifying the construction of the sewing machine because in that case there is no need to separately provide a conventional presser foot.

The invention claimed is:

1. A sewing machine capable of sewing a string-shaped material to a sewing workpiece, the sewing machine comprising:

a guide member for guiding the string-shaped material toward a sewing position, the guide member having a distal end from which the string-shaped material extends out;

a reciprocation mechanism for reciprocatingly moving the guide member in a lateral direction; and a restriction member having a laterally elongated section, the laterally elongated section extending in a reciprocating movement direction of the guide member in such a manner that the string-shaped material extending out from the distal end of the guide member is restricted to be located beneath the laterally elongated section, the laterally elongated section having a length corresponding to a range of reciprocating movement of the distal end of the guide member.

2. The sewing machine as claimed in claim 1, wherein the length of the laterally elongated section of the restriction member is such a dimension that when the distal end of the guide member is located at either one of opposite ends of the range of the reciprocating movement of the guide member, at least part of a width of the string-shaped material guided by the guide member is overlapped by the laterally elongated section.

3. The sewing machine as claimed in claim 1, wherein the length of the laterally elongated section of the restriction member is such a dimension that when the distal end of the guide member is located at either one of opposite ends of the range of the reciprocating movement of the guide member, an entire width of the string-shaped material guided by the guide member is overlapped by the laterally elongated section.

4. The sewing machine as claimed in claim 1, further comprising a height position adjustment member for adjusting a height position of the restriction member.

5. The sewing machine as claimed in claim 1, wherein the laterally elongated section is provided at a lower end of the restriction member and has an opening formed therein for enabling passage therethrough of a sewing needle.

6. The sewing machine as claimed in claim 1, wherein the restriction member is moved up and down in synchronism with a sewing operation.

7. The sewing machine as claimed in claim 1, wherein the reciprocation mechanism reciprocatingly moves the guide member in synchronism with a sewing operation.

8. The sewing machine as claimed in claim 1, wherein the guide member is moved up and down in synchronism with a sewing operation.

9. The sewing machine as claimed in claim 1, wherein the reciprocation mechanism is constructed to move the guide member linearly in the lateral direction.

10. The sewing machine as claimed in claim 1, wherein the reciprocation mechanism is constructed to swing the guide member in the lateral direction.

* * * * *